US012631178B2

(12) United States Patent
Cho

(10) Patent No.: US 12,631,178 B2
(45) Date of Patent: May 19, 2026

(54) SCROLL COMPRESSOR HAVING BACK PRESSURE CIRCULATION STRUCTURE

(71) Applicant: Hyundai Wia Corporation, Changwon (KR)

(72) Inventor: Min Kuk Cho, Seoul (KR)

(73) Assignee: Hyundai Wia Corporation, Changwon (KR)

( * ) Notice: Subject to any disclaimer, the term of this patent is extended or adjusted under 35 U.S.C. 154(b) by 41 days.

(21) Appl. No.: 18/135,522

(22) Filed: Apr. 17, 2023

(65) Prior Publication Data

US 2023/0358231 A1 Nov. 9, 2023

(30) Foreign Application Priority Data

May 9, 2022 (KR) ..... 10-2022-0056651

(51) Int. Cl.
*F04C 18/02* (2006.01)

(52) U.S. Cl.
CPC ..... *F04C 18/0215* (2013.01)

(58) Field of Classification Search
CPC .. F04C 2/025; F04C 18/0215; F04C 18/0223; F04C 18/02; F01C 1/0215; F01C 1/0223
See application file for complete search history.

(56) References Cited

U.S. PATENT DOCUMENTS

2006/0210416 A1* 9/2006 Morimoto ..... F04C 18/0215 418/55.1
2007/0212244 A1* 9/2007 Futagami ..... F04C 18/0215 418/55.1
2014/0010693 A1* 1/2014 Imada ..... F04C 29/12 418/55.2
2018/0363651 A1* 12/2018 Seong ..... F04C 28/26
2019/0242384 A1* 8/2019 Yoo ..... F04C 18/0261
2019/0301461 A1* 10/2019 Yamashita ..... F04C 18/0261
2022/0275802 A1* 9/2022 Nakatani ..... F04C 15/0088

FOREIGN PATENT DOCUMENTS

| | | | | |
|---|---|---|---|---|
| CN | 109661517 A | | 4/2019 | |
| JP | 2015-038327 A | | 2/2015 | |
| JP | 2022502604 A | | 1/2022 | |
| KR | 20050028216 A | * | 3/2005 | ..... F04C 18/02 |
| KR | 10-0557058 B1 | | 3/2006 | |
| KR | 100564968 B1 | | 3/2006 | |
| KR | 10-2020-0045426 A | | 5/2020 | |
| KR | 10-2022-0008977 A | | 1/2022 | |

OTHER PUBLICATIONS

Machine Translation of KR 20050028216 A to Koo, retrieved from espacenet on Jul. 8, 2025 (Year: 2025).*
Office Action issued on Aug. 24, 2023 in corresponding Korean Patent Application No. 10-2022-0056651.
Office Action issued on Nov. 29, 2025 in corresponding Chinese Patent Application No. 202310515093.0.

* cited by examiner

*Primary Examiner* — Essama Omgba
*Assistant Examiner* — Dnyanesh G Kasture
(74) *Attorney, Agent, or Firm* — Fox Rothschild LLP

(57) ABSTRACT

A scroll compressor for an air conditioning system of a vehicle includes a back pressure circulation structure. Oil and refrigerant discharged from a back pressure chamber to maintain back pressure are directly emitted toward a scroll to ensure circulation of refrigerant. The size of a package incorporating the scroll compressor is reduced through structural simplification.

11 Claims, 5 Drawing Sheets

SCROLL COMPRESSOR HAVING BACK PRESSURE CIRCULATION STRUCTURE

CROSS REFERENCE TO RELATED APPLICATION

The present application claims under 35 U.S.C. § 119(a) the benefit of Korean Patent Application No. 10-2022-0056651, filed May 9, 2022, the entire contents of which are incorporated by reference herein.

BACKGROUND

(a) Technical Field

The present disclosure relates to a scroll compressor for an air conditioning system of a vehicle, more particularly, to the scroll compressor having a back pressure circulation structure configured such that oil and refrigerant discharged from a back pressure chamber to maintain back pressure are directly emitted toward a scroll to ensure circulation of refrigerant.

(b) Description of the Related Art

Generally, a scroll compressor is a cooling and heating component of an air conditioning system. The scroll compressor is one of a plurality of compressors drawing low-temperature and low-pressure refrigerant from an evaporator, compressing the low-temperature and low-pressure refrigerant into high-temperature and high-pressure refrigerant, and discharging high-temperature and high-pressure refrigerant to a condenser.

Such a scroll compressor typically includes: a housing having an inlet; a rotating shaft connected to a rotor provided inside a stator disposed inside the housing; an orbiting scroll connected to the rotating shaft to orbit; a fixed scroll engaged with the orbiting scroll to define a pair of compression chambers; a main frame coupled to the fixed scroll, with the orbiting scroll being positioned between the main frame and the fixed scroll, to be seated on the housing; an anti-rotation unit preventing the orbiting scroll from rotating on the axis of the anti-rotation unit; and a top cap provided with an oil separator and an outlet. The scroll compressor operates as follows.

Refrigerant gas drawn through the inlet flows to the compression chambers defined by the engagement of the orbiting scroll and the fixed scroll to be compressed in the compression chambers.

Compressed refrigerant gas is discharged from the central portion of the fixed scroll. Oil is separated from the refrigerant gas and moves to an oil reservoir, and the refrigerant gas is discharged through the outlet.

At this time, leakage is caused by gas pressure generated in a tangential direction, an axial direction, and a radial direction by the pressure of the compressed refrigerant gas. There are a variety of structures for reducing such leakage, from which a fixed scroll back pressure system, an orbiting scroll back pressure system, a top seal system, and the like are provided to reduce leakage from being caused by gas pressure generated in an axial direction.

However, when the pressure of a back pressure chamber is used, an excessively low pressure of the back pressure chamber may increase a gap, thereby degrading scroll performance. An excessively high pressure of the back pressure chamber may increase abrasion, thereby causing a structural problem. For these reasons, it is required to adjust the pressure at a predetermined level. When the pressure is high, pressure relief is required to lower the pressure of the back pressure chamber. Since the pressure of the back pressure chamber is higher than intake pressure, decompression is essentially required before the pressure relief.

Accordingly, in the related art, a hollow space of the rotating shaft is used to decompress refrigerant while the refrigerant is moving through a gap between a bearing and a shaft at the distal end of the rotating shaft or discharge the refrigerant toward a motor housing. A separate decompression device may be provided on the motor housing side for decompression.

However, with increases in the path through which refrigerant and oil flow, oil may not be supplied in a situation in which oil is insufficient. As a separate structure is applied to the motor housing side, the entire size may be increased, thereby being disadvantageous when packaged.

The foregoing is intended merely to aid in the understanding of the background of the present disclosure, and is not intended to mean that the present disclosure falls within the purview of the related art that is already known to those skilled in the art.

SUMMARY

Accordingly, the present disclosure discloses a scroll compressor having a back pressure circulation structure configured such that oil and refrigerant discharged from a back pressure chamber to maintain back pressure are directly emitted toward a scroll to ensure circulation of refrigerant and oil. The back pressure circulation structure of the present disclosure has a simplified structure as compared to conventional devices, and thus an overall size of a package incorporating the scroll compressor may be reduced as compared to conventional devices. The scroll compressor of the present disclosure may be incorporated into an air conditioning system of a vehicle.

In order to achieve the above objective, according to one aspect of the present disclosure, there is provided a scroll compressor having a back pressure circulation structure. The scroll compressor may include: a motor housing; a main frame seated on the motor housing; a drive shaft connected to a motor provided inside the motor housing to rotate using rotational force received from the motor; an orbiting scroll provided on the main frame, connected to the drive shaft in an orbiting manner, and including a spiral orbiting lap; a back pressure chamber provided on one side of the orbiting scroll within the main frame; a fixed scroll including a spiral fixed lap configured to match and engage with the orbiting lap of the orbiting scroll; and a recovery flow path provided in the main frame and extending from the back pressure chamber to communicate with the fixed scroll. The fixed scroll may include a decompression part included of a communication hole spaced apart from the fixed lap and communicating with the recovery flow path, a flow path extending from the communication hole, and an open hole provided at a distal end of the flow path to be open toward the orbiting lap and the fixed lap.

The recovery flow path may include a first recovery path extending from the back pressure chamber and a second recovery path branched from the first recovery path to communicate with the fixed scroll.

A diameter of the first recovery path may be greater than a diameter of the second recovery path.

The second recovery path may be branched from the first recovery path at a position spaced apart from a distal end of the first recovery path, such that an acute angle is defined between the first recovery path and the second recovery path.

The flow path may be disposed outside and spaced apart from the fixed lap and be curved along the fixed lap.

A plurality of open holes may be provided to be open toward the orbiting lap and the fixed lap both in an outward direction and an inward direction.

According to another aspect of the present disclosure, there is provided a scroll compressor having a back pressure circulation structure. The scroll compressor may include: a motor housing; a main frame seated on the motor housing; a drive shaft connected to a motor provided inside the motor housing to rotate using rotational force received from the motor; an orbiting scroll provided on the main frame, connected to the drive shaft in an orbiting manner, and including a spiral orbiting lap; a back pressure chamber provided on one side of the orbiting scroll within the main frame; a fixed scroll including a spiral fixed lap configured to match and engage with the orbiting lap of the orbiting scroll; a recovery flow path provided in the main frame and extending from the back pressure chamber to communicate with the fixed scroll; and an oil filter provided on the recovery flow path to filter foreign matter contained in fluid discharged from the back pressure chamber. The fixed scroll may include a decompression part included of a communication hole spaced apart from the fixed lap and communicating with the recovery flow path, a flow path extending from the communication hole, and an open hole provided at a distal end of the flow path to be open toward the orbiting lap and the fixed lap.

The recovery flow path may include a first recovery path extending from the back pressure chamber and a second recovery path branched from the first recovery path to communicate with the fixed scroll. The oil filter may be provided on the first recovery path, and the second recovery path may be branched from the first recovery path at a position spaced apart from the oil filter.

According to another aspect of the present disclosure, there is provided a scroll compressor having a back pressure circulation structure. The scroll compressor may include: a motor housing; a main frame seated on the motor housing; a drive shaft connected to a motor provided inside the motor housing to rotate using rotational force received from the motor; an orbiting scroll provided on the main frame, connected to the drive shaft in an orbiting manner, and including a spiral orbiting lap; a back pressure chamber provided on one side of the orbiting scroll within the main frame; a fixed scroll including a spiral fixed lap configured to match and engage with the orbiting lap of the orbiting scroll; a recovery flow path provided in the main frame and extending from the back pressure chamber to communicate with the fixed scroll; and a decompression unit provided on the recovery flow path to reduce a pressure of fluid flowing from the back pressure chamber toward the fixed scroll and the orbiting scroll. The fixed scroll may include a decompression part included of a communication hole spaced apart from the fixed lap and communicating with the recovery flow path, a flow path extending from the communication hole, and an open hole provided at a distal end of the flow path to be open toward the orbiting lap and the fixed lap.

The decompression unit may include a plurality of chambers and through holes connecting the chambers.

The decompression unit may be configured such that the through holes do not overlap in a longitudinal direction of each of the chambers.

In the scroll compressor having the back pressure circulation structure as described above, refrigerant discharged from a back pressure chamber to maintain back pressure and oil may be directly emitted toward a scroll to ensure circulation of refrigerant and oil, and the size of a package incorporating the scroll compressor may be reduced through structural simplification, as compared to conventional devices.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
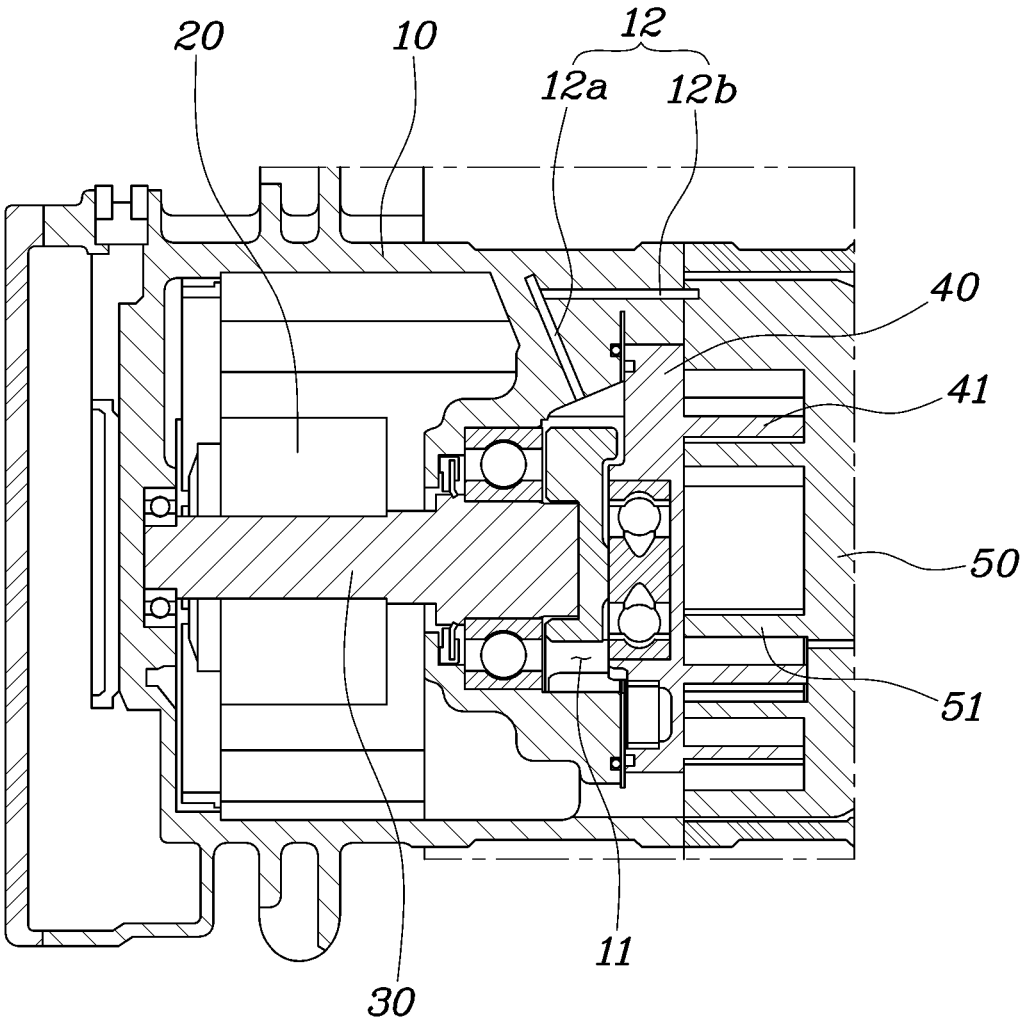
FIG. 1 a cross-sectional side view illustrating a scroll compressor having a back pressure circulation structure according to the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, a scroll compressor having a back pressure circulation structure for an air conditioning system of a vehicle according to an exemplary embodiment of the present disclosure will be described with reference to the accompanying drawings.

Hereinafter, embodiments disclosed in the present disclosure will be described in detail with reference to the accompanying drawings, in which identical or similar constituent elements are given the same reference numerals regardless of the reference numerals of the drawings, and a repeated description thereof will be omitted.

In the description of the present disclosure, when it is determined that the detailed description of the related art would obscure the gist of the present disclosure, the detailed description thereof will be omitted. In addition, the attached drawings are merely intended to be able to readily understand the embodiments disclosed herein, and thus the technical idea disclosed herein is not limited by the attached drawings, and it should be understood to include all changes, equivalents, and substitutions included in the idea and technical scope of the present disclosure.

It will be understood that, although the terms "first", "second", etc., may be used herein to describe various elements, these elements should not be limited by these terms. These terms are only used to distinguish one element from another element.

It will be understood that when an element is referred to as being "coupled", "connected", or "linked" to another element, it can be directly coupled or connected to the other element or intervening elements may be present therebetween. In contrast, it should be understood that when an element is referred to as being "directly coupled", "directly connected", or "directly connected" to another element, there are no intervening elements present.

Hereinafter, exemplary embodiments of the present disclosure will be described in detail with reference to the accompanying drawings. Throughout the drawings, the same reference numerals will refer to the same or like parts.

Figure 2:
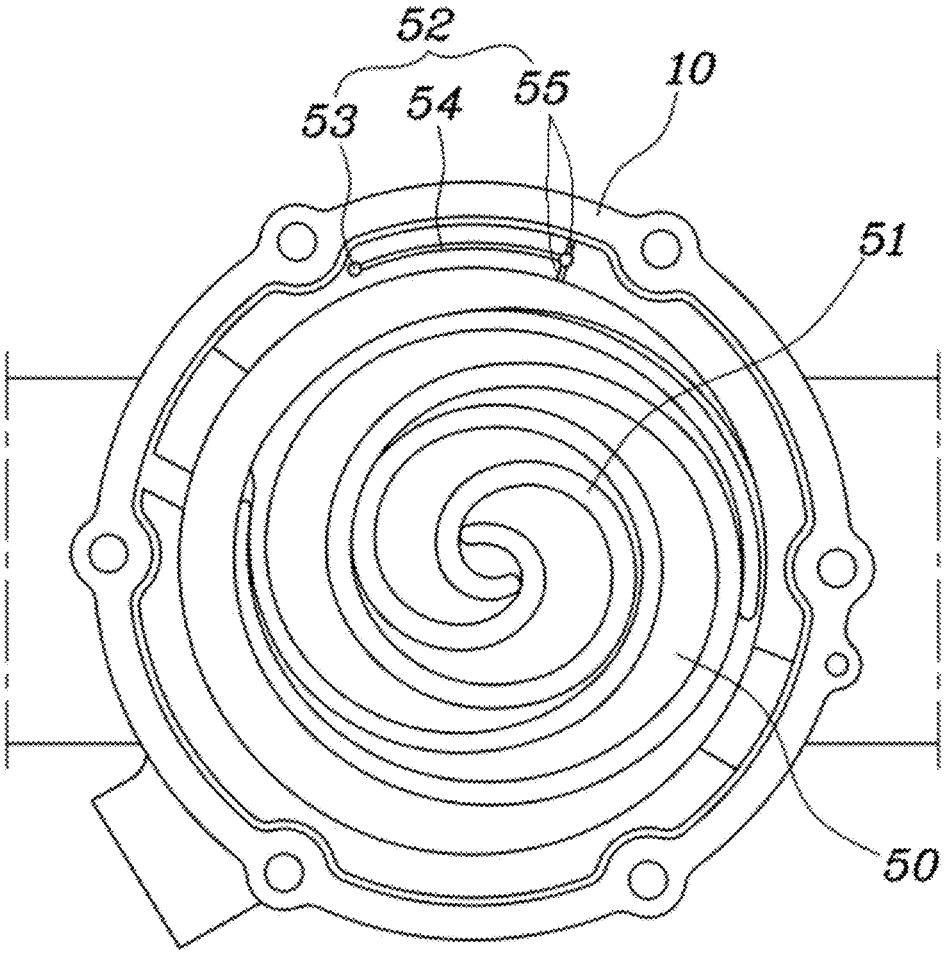
FIG. 2 an end view illustrating a fixed scroll of the scroll compressor in which the back pressure circulation structure illustrated in FIG. 1 is used.
Figure 3:
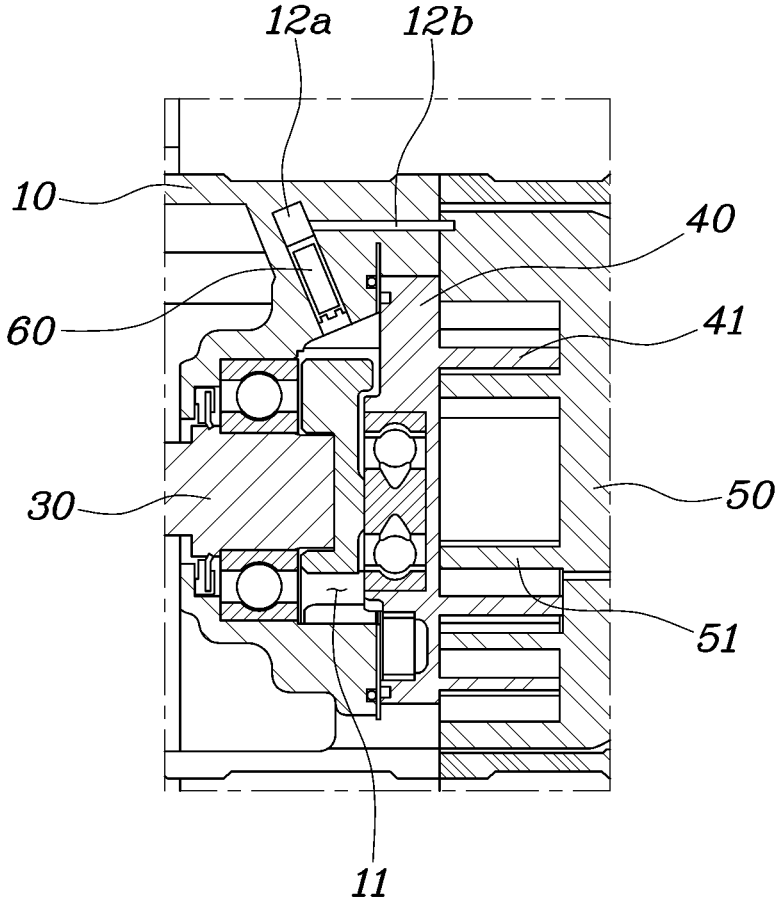
FIG. 3 is a cross-sectional side view illustrating an embodiment of the scroll compressor according to the present disclosure.
Figure 4:
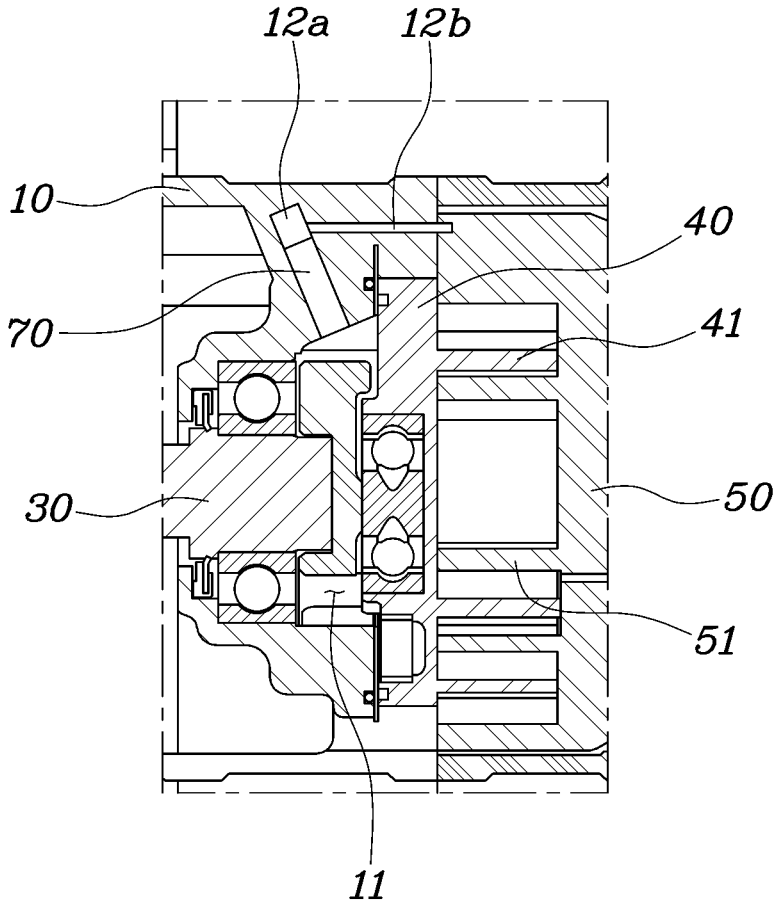
FIG. 4 is a cross-sectional side view illustrating another embodiment of the scroll compressor according to the present disclosure.
Figure 5:
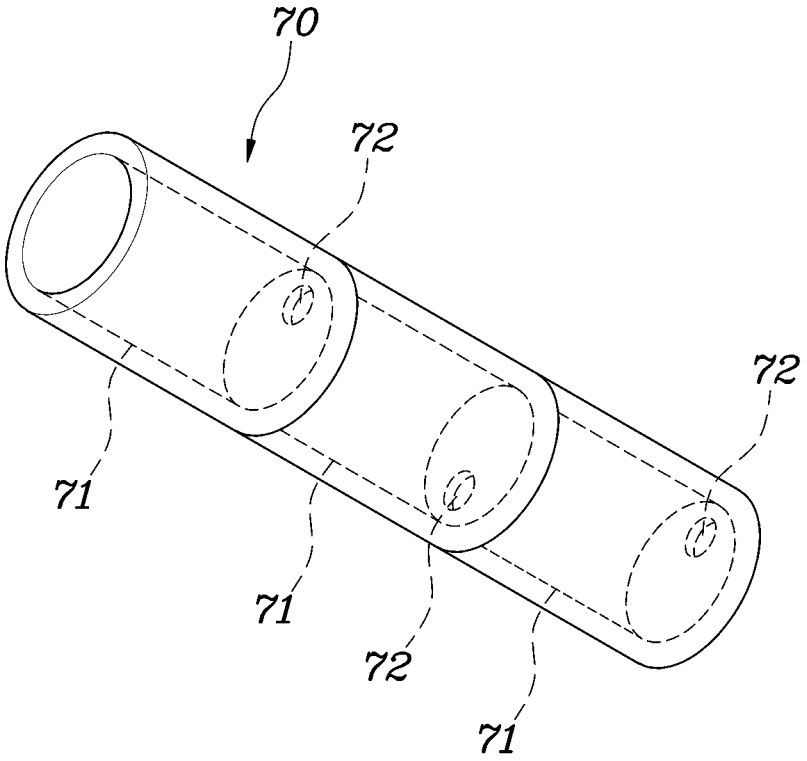
FIG. 5 is a perspective view of a decompression unit according to the present disclosure.

FIG. 1 is a cross-sectional side view illustrating a scroll compressor having a back pressure circulation structure according to the present disclosure, FIG. 2 is an end view illustrating a fixed scroll of the scroll compressor in which the back pressure circulation structure illustrated in FIG. 1 is used, FIG. 3 is a cross-sectional side view illustrating an embodiment of the scroll compressor according to the present disclosure, FIG. 4 is a cross-sectional side view illustrating another embodiment of the scroll compressor according to the present disclosure, and FIG. 5 is a perspective view illustrating a decompression unit according to the present disclosure.

As illustrated in FIGS. 1 and 2, the scroll compressor having a back pressure circulation structure according to the present disclosure includes: a motor housing H; a main frame 10 seated on the motor housing H; a drive shaft 30 connected to a motor 20 provided inside the motor housing H to rotate using rotational force received from the motor 20; an orbiting scroll 40 provided on the main frame 10, connected to the drive shaft 30 in an orbiting manner, and including a spiral orbiting lap 41; a back pressure chamber 11 provided on one side of the orbiting scroll 40 within the main frame 10; a fixed scroll 50 including a spiral fixed lap 51 configured to match and engage with the orbiting lap 41 of the orbiting scroll 40; and a recovery flow path 12 provided in the main frame 10 and extending from the back pressure chamber 11 to communicate with the fixed scroll 50.

The main frame 10 is coupled to one surface of the motor housing H, and the orbiting scroll is mounted within the main frame 10 to enable scroll compression. In addition, the motor 20 is provided within the motor housing H to generate rotational power by receiving electric power. The drive shaft 30 is connected to the motor 20 to be rotated by operation of the motor 20. The orbiting scroll 40 is connected to the drive shaft 30 to orbit together with the drive shaft 30, and the spiral orbiting lap 41 is provided on the orbiting scroll 40.

In addition, the fixed scroll 50 is positioned within the main frame 10 to match the orbiting scroll 40 and is configured to engage with the orbiting scroll 40. The fixed scroll 50 is provided with the spiral fixed lap 51 disposed inside and configured to engage with the orbiting lap 41 of the orbiting scroll 40. With this configuration, a compression chamber is defined between the fixed lap 51 and the orbiting lap 41. When the orbiting scroll 40 orbits, fluid containing refrigerant and oil enters the compression chamber. In response to rotation of the orbiting lap 41, the space of the compression chamber is reduced, so that the fluid is compressed and then is discharged from the compression chamber.

In addition, the back pressure chamber 11 is provided between the main frame 10 and the orbiting scroll 40. The back pressure chamber 11 allows the orbiting scroll 40 to be pushed toward the fixed scroll 50 in response to the pressure on one side of the orbiting scroll 40 within the back pressure chamber 11. The back pressure chamber 11 may be provided with a valve or a pressure reducing device allowing oil having a suitable pressure to be supplied to the back pressure chamber 11.

The present disclosure is intended to overcome the problem caused by excessive low or high pressure generated within the back pressure chamber 11 when the orbiting scroll 40 is supported using the pressure of the back pressure chamber 11. The recovery flow path 12 is configured to adjust the pressure within the back pressure chamber 11 at a suitable level. That is, when the pressure of the back pressure chamber 11 is excessively low, the gap may be increased, thereby degrading performance in response to driving of each scroll. When the pressure of the back pressure chamber 11 is excessively high, abrasion may occur, thereby leading to a structural problem.

Accordingly, the pressure within the back pressure chamber 11 is required to be adjusted at a suitable level. In particular, when the pressure is high, fluid relief is required in order to lower the pressure within the back pressure chamber 11. Since the pressure within the back pressure chamber 11 is higher than intake pressure, decompression is essentially required before the pressure relief.

Accordingly, in an embodiment according to the present disclosure, the recovery flow path 12 extends from the back pressure chamber 11 to communicate with the fixed scroll 50.

In addition, the fixed scroll 50 includes a decompression part 52 having a communication hole 53 spaced apart from the fixed lap 51 and communicating with the recovery flow path 12, a flow path 54 extending from the communication hole 53, and an open hole 55 provided at a distal end of the flow path 54 to be open toward the orbiting lap 41 and the fixed lap 51.

According to this configuration, fluid including refrigerant gas and oil flows from the back pressure chamber 11 through the recovery flow path 12 to enter the communication hole 53 of the fixed scroll 50. After decompressed while passing through the flow path 54, the fluid flows toward the orbiting lap 41 and the fixed lap 51 through the open hole 55.

Here, the recovery flow path 12 is connected to the back pressure chamber 11 and the communication hole 53 of the fixed scroll 50 to provide a path through which fluid from the back pressure chamber 11 flows toward the fixed lap 51 and the orbiting lap 41. The recovery flow path 12 includes a first recovery path 12*a* extending from the back pressure chamber 11 and a second recovery path 12*b* branched from the first recovery path 12*a* to communicate with the fixed scroll 50.

In this manner, the recovery flow path 12 includes the first recovery path 12*a* and the second recovery path 12*b*, such that fluid discharge from the back pressure chamber 11 flows from the first recovery path 12*a* to the second recovery path 12*b* and then to the decompression part 52 of the fixed scroll 50. In particular, due to the extending shapes of the first recovery path 12*a* and the second recovery path 12*b* of the recovery flow path 12, the distance of the back pressure chamber 11 to the decompression part 52 of the fixed scroll 50 may be reduced. Thus, even in a situation in which oil within the fixed scroll 50 and the orbiting scroll 40 is insufficient, fluid including oil within the back pressure chamber 11 may be rapidly supplied through the recovery flow path 12.

In addition, a diameter of the first recovery path 12*a* may be formed to be greater than a diameter of the second recovery path 12*b*. Due to the difference of the diameter between the first recovery path 12*a* and the second recovery path 12*b*, a decompressing effect is generated by an orifice structure. The difference of the diameter between the first recovery path 12*a* and the second recovery path 12*b* may be determined depending on the degree of decompression of fluid.

In addition, the second recovery path 12*b* may be branched from the first recovery path 12*a* at a position spaced apart from the distal end of the first recovery path 12*a*, such that an acute angle is defined between the first recovery path 12*a* and the second recovery path 12*b*. Thus, the recovery flow path 12 may be designed such that the first recovery path 12*a* is not interfered with a bearing structure or a center head in the main frame 10 and the second recovery path 12*b* is connected to the decompression part 52 of the fixed scroll 50. Furthermore, fluid flowing in the back pressure chamber 11 fills up the recovery path 12*a* and then flows to the second recovery path 12*b*, whereby a decompression effect may occur in the recovery flow path 12.

In addition, according to an embodiment of the recovery flow path 12, as illustrated in FIG. 3, an oil filter 60 may be provided on the recovery flow path 12. That is, the oil filter 60 may be provided on the first recovery path 12*a*, and the second recovery path 12*b* may be branched from the first recovery path 12*a* at a position spaced apart from the oil filter 60. In this manner, the oil filter 60 is configured such that, when fluid from the back pressure chamber 11 flows toward the decompression part 52 of the fixed scroll 50 through the recovery flow path 12, the fluid passes through the oil filter 60. That is, friction occurs between components including the drive shaft 30 in the back pressure chamber 11. The friction between the components produces foreign matter, and when the foreign matter is introduced toward the fixed lap 51 or the orbiting lap 41, damage may be caused to the components. Accordingly, since the oil filter 60 is provided on the first recovery path 12*a* of the recovery flow path 12, the foreign matter contained in the fluid discharged from the back pressure chamber 11 may be filtered, thereby improving the durability of each scroll. In addition, the fluid discharged from the back pressure chamber 11 passing through the oil filter 60 may also create a decompression effect.

In addition, according to another embodiment of the recovery flow path 12, as illustrated in FIG. 4, a decompression unit 70 may be provided on the recovery flow path 12. That is, the decompression unit 70 is provided on the first recovery path 12*a*. The decompression unit 70 includes a plurality of chambers 71 and through holes 72 connecting the chambers 71. The decompression unit 70 is configured to allow fluid to be supplied to the back pressure chamber 11 in a suitable pressure. The decompression unit 70 is provided on the first recovery path 12*a* of the recovery flow path 12 to reduce the pressure of fluid flowing from the back pressure chamber 11 toward the fixed scroll 50 and the orbiting scroll 40.

The decompression unit 70 includes the plurality of chambers 71 and the through holes 72 connecting the chambers 71. With this configuration, oil in fluid may be decompressed due to throttling occurring in the fluid passing through the chambers 71 and the through holes 72.

In particular, the decompression unit 70 is configured such that the through holes 72 do not overlap in a longitudinal direction of respective chambers 71. As illustrated in FIG. 5, in the decompression unit 70, the plurality of through holes 72 connecting the chambers 71 are arranged such that centers of the through holes 72 are not coaxial, and are in a staggered arrangement so as not to overlap each other in the longitudinal direction. Thus, the decompression effect caused by fluid flowing through the plurality of chambers 71 and the through holes 72 of the decompression unit 70 may be increased.

In addition, fluid that has flowed from the back pressure chamber 11 to the decompression part 52 of the fixed scroll 50 through the recovery flow path 12 may be decompressed again while passing through the decompression part 52 and then flow to the fixed lap 51 and the orbiting lap 41.

Since the decompression part 52 includes the communication hole 53 spaced apart from the fixed lap 51 and communicating with the recovery flow path 12, the flow path 54 extending from the communication hole 53, and the open hole 55 provided at the distal end of the flow path 54 to be open toward the orbiting lap 41 and the fixed lap 51, fluid that has entered through the communication hole 53 is decompressed while passing through the decompression flow path, and then flows to the orbiting lap 41 and the fixed lap 51 through the open hole 55.

Here, the flow path 54 may be disposed outside and spaced apart from the fixed lap 51 and be curved along the fixed lap 51. That is, the decompression part 52 may be disposed outside and spaced apart from the fixed lap 51 so as not to interfere with the fixed lap 51. In addition, fluid is discharged while gradually flowing inward in response to the rotation of the orbiting scroll 40. Since the decompression part 52 is disposed outside and spaced apart from the fixed lap 51, fluid discharged through the open hole 55 of the decompression part 52 may move from outside to inside in response to the rotation of the orbiting scroll 40.

In addition, in the decompression part 52, the flow path 54 extends while being curved along the fixed lap 51 so as not to interfere with the fixed lap 51. Thus, an extension length may be obtained, thereby obtaining a decompression effect through the decompression flow path.

In addition, a plurality of open holes 55 may be provided to be open toward the orbiting lap 41 and the fixed lap 51 both in an outward direction and an inward direction. As the plurality of open holes 55 is provided in this manner, the discharge pressure of fluid that has flowed through the flow path 54 is lowered while the fluid is being discharged through the plurality of open holes 55.

As set forth above, the present disclosure allows fluid to flow through the decompression part 52 provided on the outer portion of the fixed scroll 50 through the recovery flow path 12 communicating with the back pressure chamber 11 of the main frame 10. In particular, the recovery flow path 12 is provided with the oil filter 60 or the decompression unit 70 through which primary decompression of fluid is performed, and secondary decompression of fluid is performed through the flow path 54 of the decompression part 52.

Furthermore, the recovery flow path 12 directly connected from the back pressure chamber 11 to the decompression part 52 of the fixed scroll 50 has a shorter length than a hollow path of the motor 20 of the related art or a flow path of fluid through a separate path of the motor housing. Thus, oil may be supplied rapidly to respective scrolls at a sufficient flow rate, thereby improving durability of the fixed scroll 50 and the orbiting scroll 40.

Although the exemplary embodiments of the present disclosure have been described for illustrative purposes, those skilled in the art will appreciate that various modifications, additions, and substitutions are possible, without departing from the scope and spirit of the present disclosure as disclosed in the accompanying claims.

What is claimed is:

1. A scroll compressor having a back pressure circulation structure, the scroll compressor comprising:

a motor housing;

a main frame seated on the motor housing;

a drive shaft connected to a motor provided inside the motor housing to rotate using rotational force received from the motor;

an orbiting scroll provided on the main frame, connected to the drive shaft in an orbiting manner, and comprising a spiral orbiting lap;

a back pressure chamber provided on one side of the orbiting scroll within the main frame;

a fixed scroll comprising a spiral fixed lap configured to match and engage with the orbiting lap of the orbiting scroll; and a recovery flow path provided in the main frame and extending from the back pressure chamber to communicate with the fixed scroll, wherein the fixed scroll comprises a decompression part having a communication hole spaced apart from the fixed lap and communicating with the recovery flow path, a flow path extending from the communication hole, and an open hole provided at a distal end of the flow path to be open toward the orbiting lap and the fixed lap, wherein in the decompression part, the flow path is disposed outside and spaced apart from the fixed lap and is curved along the fixed lap, and wherein in the decompression part, a plurality of open holes are provided, one of the plurality of open holes is configured to be open toward the orbiting lap in an outward direction of the orbiting lap, and another of the plurality of open holes is configured to be open toward the fixed lap in an inward direction of the fixed lap.

2. An air conditioning system of a vehicle comprising the scroll compressor of claim 1.

3. A vehicle comprising the scroll compressor of claim 1.

4. The scroll compressor of claim 1, wherein the scroll compressor further comprises:

an oil filter provided on the recovery flow path to filter foreign matter contained in fluid discharged from the back pressure chamber.

5. The scroll compressor of claim 4, wherein the oil filter is provided on a first recovery path, and a second recovery path is branched from the first recovery path at a position spaced apart from the oil filter.

6. The scroll compressor of claim 1, wherein the scroll compressor further comprises:

a decompression unit provided on the recovery flow path to reduce a pressure of fluid flowing from the back pressure chamber toward the fixed scroll and the orbiting scroll.

7. The scroll compressor of claim 6, wherein the decompression unit comprises a plurality of chambers and through holes connecting the chambers.

8. The scroll compressor of claim 7, wherein the decompression unit is configured such that the through holes do not overlap in a longitudinal direction of each of the chambers.

9. The scroll compressor of claim 1, wherein the recovery flow path comprises a first recovery path extending from the back pressure chamber and a second recovery path branched from the first recovery path to communicate with the fixed scroll.

10. The scroll compressor of claim 9, wherein a diameter of the first recovery path is greater than a diameter of the second recovery path.

11. The scroll compressor of claim 9, wherein the second recovery path is branched from the first recovery path at a position spaced apart from a distal end of the first recovery path, such that an acute angle is defined between the first recovery path and the second recovery path in the main frame.

* * * * *